US007198535B2

(12) United States Patent
Lin et al.

(10) Patent No.: US 7,198,535 B2
(45) Date of Patent: Apr. 3, 2007

(54) SPACERS MOUNTING STRUCTURE AND METHOD FOR A FIELD EMISSION DISPLAY

(75) Inventors: Wei-Yi Lin, Tuku Jen (TW); Ming-Chun Hsiao, Judung Jen (TW); Ying-Hsing Chen, Kaohsiung (TW); Chi-Min Tseng, Jubei (TW); Yun-Jiao Hsiao, Tunchi Li (TW)

(73) Assignee: Industrial Technology Research Institute (TW)

( * ) Notice: Subject to any disclaimer, the term of this patent is extended or adjusted under 35 U.S.C. 154(b) by 73 days.

(21) Appl. No.: 11/171,221

(22) Filed: Jul. 1, 2005

(65) Prior Publication Data

US 2005/0242697 A1 Nov. 3, 2005

Related U.S. Application Data

(62) Division of application No. 10/647,236, filed on Aug. 26, 2003, now Pat. No. 7,008,286.

(30) Foreign Application Priority Data

Apr. 22, 2003 (TW) ..... 92109418 A

(51) Int. Cl.
*H01J 9/00* (2006.01)
*H01J 9/24* (2006.01)

(52) U.S. Cl. ..... 445/66; 445/24

(58) Field of Classification Search ..... 445/24, 445/66

See application file for complete search history.

(56) References Cited

U.S. PATENT DOCUMENTS

| | | | | |
|---|---|---|---|---|
| 5,600,203 | A * | 2/1997 | Namikawa et al. | 313/495 |
| 6,068,532 | A * | 5/2000 | Lai et al. | 445/24 |
| 6,176,753 | B1 * | 1/2001 | Pong et al. | 445/24 |
| 6,312,302 | B1 * | 11/2001 | Na | 445/24 |
| 6,593,682 | B2 * | 7/2003 | Jung et al. | 313/292 |
| 2004/0137820 | A1 * | 7/2004 | Yakou et al. | 445/24 |

* cited by examiner

*Primary Examiner*—Mariceli Santiago
(74) *Attorney, Agent, or Firm*—Bacon & Thomas PLLC

(57) ABSTRACT

The present invention relates to a supporting spacer mounting structure and method for a field emission display. By using a supporting spacer structure being cross-shaped or rectangle-shaped and being made of glass, ceramics or metal, and employing the vacuum absorption of a clipping arm with special design and the real time monitoring of a monitoring lens, the position-aligning is preliminarily performed on a supporting spacer, and then the supporting spacer is positioned on a required location so as to provide the supporting force needed by a display.

7 Claims, 5 Drawing Sheets

SPACERS MOUNTING STRUCTURE AND METHOD FOR A FIELD EMISSION DISPLAY

CROSS REFERENCE TO RELATED APPLICATION

This application is a divisional application of U.S. application Ser. No. 10/647,236, filed Aug. 26, 2003, now U.S. Pat. No. 7,008,286 issued on Mar. 7, 2006, of which the entire disclosure is hereby incorporated by reference.

BACKGROUND OF THE INVENTION

1. Field of the Invention

The present invention relates to spacers mounting structure and method for a field emission display. By using the clipping arm designed for the spacers and the CCD for real time monitoring, the cross-shaped or rectangle-shaped spacers will be mounted in the field emission display unit for supporting the display.

2. Description of the Prior Art

As digital technology is advancing and the internet is popular, the application or plane display are varied from portable consumer products to large-scale panel for information advertisement, even the very large-scale panel for video communication. Therefore, the general cathode ray displays are not sufficient for these applications. As the plasma display panels (PDP) with a large area and capable of emitting light automatically are merchandized and produced in a mass scale in the recent years, the technology for developing the plane displays with low cost and large area is advanced in a surprising speed. Now, the tendency is to develop the technology for the mass production of the field emission displays. Therefore, the material fields for the liquid crystal displays and the field emission displays will have more developments as the related technology advances. The materials are developed to be compound, light, thin, large, flexible, and low costing so as to promote the competition ability for the liquid crystal display and field emission display industry.

In the prior art field emission display, there are different ways to position the supporting spacers. However, there are some drawbacks in the mounting of the prior art supporting spacers. Please refer to FIG. 1. FIG. 1 is a perspective diagram of a prior art field emission display unit. The field emission display comprises a plurality of field emission display units 1, and each of the field emission display units 1 comprises a lower plate 10 and an upper plate 30. And a supporting spacer 20 is mounted between them for division fixing and supporting. As shown in FIG. 1, each of the field emission display units 1 comprises three cathode emitters 60 and three light-emitting sources 70. A cathode electrode 50 is used as a base for each of the cathode emitters 60, and the third electrode and dielectric layer device 40 is used for avoiding shorting with cathode electrodes and pulling up the electrons of the cathode emitters 60. When the cathode emitters 60 emit electrons 61 to the light-emitting sources 70, the light-emitting sources will emit the light correspondingly, and by adjusting the color series, the required color lighting points will be obtained so as to form the required color images.

Please refer to FIG. 2. FIG. 2 is a perspective diagram of a prior art supporting spacers structure. As shown in FIG. 2, the prior art supporting device 20 comprises a plurality of openings 21.

Although the supporting spacers employed in the prior art is not limited to the supporting device 20 and the opening 21 is not limited to be rectangle, in the practical application, the characteristics of the vacuum elements have to be considered when employing the supporting spacers of the field emission display so as to maintain a high air conductivity or the strength for resisting the atmosphere pressure. Therefore, a supporting spacer with a greater width-height ratio has to be obtained without affecting the frame quality of the display. This makes the employed supporting spacers in the prior art can not achieve the requirement of high resolution.

Furthermore, in the prior art supporting spacers, a mechanical arm or a clipping claw is used as the clipping portion, and this will cause the damages of the supporting spacers because of the mechanical stress.

In the prior art, a mechanical clipping device is employed in the positioning and position-aligning, and the area of the supporting spacer is excessively large. Therefore, the requirement of more precise field emission display cannot be achieved.

SUMMARY OF THE INVENTION

In order to resolve the drawbacks of the prior art, the present invention provides a supporting spacer mounting structure and method for a field emission display so as to overcome the obstacles of the technology development in the prior art. By using a cross-shaped supporting spacer or a rectangle supporting spacer structure, and mounting a supporting spacer by the vacuum absorption of a clipping arm, and using a monitoring lens for a real time monitoring, the operation of embedding the supporting spacers into the field emission display unit is accomplished.

The height of the cross-shaped or rectangle-shaped supporting spacers used in the present invention is about 0.1 centimeters, and the length of the extended arm is about 0.1 centimeters while the thickness is about 100 micrometer. Therefore, the preciseness is sufficient to achieve the requirement of high resolution for the field emission display. The employed material is glass, ceramics or metal so that the hardness of the material is capable of satisfying the need for supporting the field emission display. Besides, a clipping arm having a positioning slot is used as a mounting structure, and therefore, when performing the operation of positioning the supporting spacer, one arm of the supporting spacer is embedded into the positioning slot and then adsorption opening on the clipping arm will absorb the supporting spacer so as to move the spacer to the required position for mounting.

Furthermore, a monitoring lens is used for monitoring the entire process of the operation so that the supporting spacer can be precisely positioned in the unit of the field emission display.

BRIEF DESCRIPTION OF THE DRAWINGS

The accompanying drawings, which are incorporated in and form part of the specification in which like numerals designate like parts, illustrate preferred embodiments of the present invention and together with the description, serve to explain the principles of the invention. In the drawings.

DETAILED DESCRIPTION OF THE PREFERRED EMBODIMENT

Figure 1:
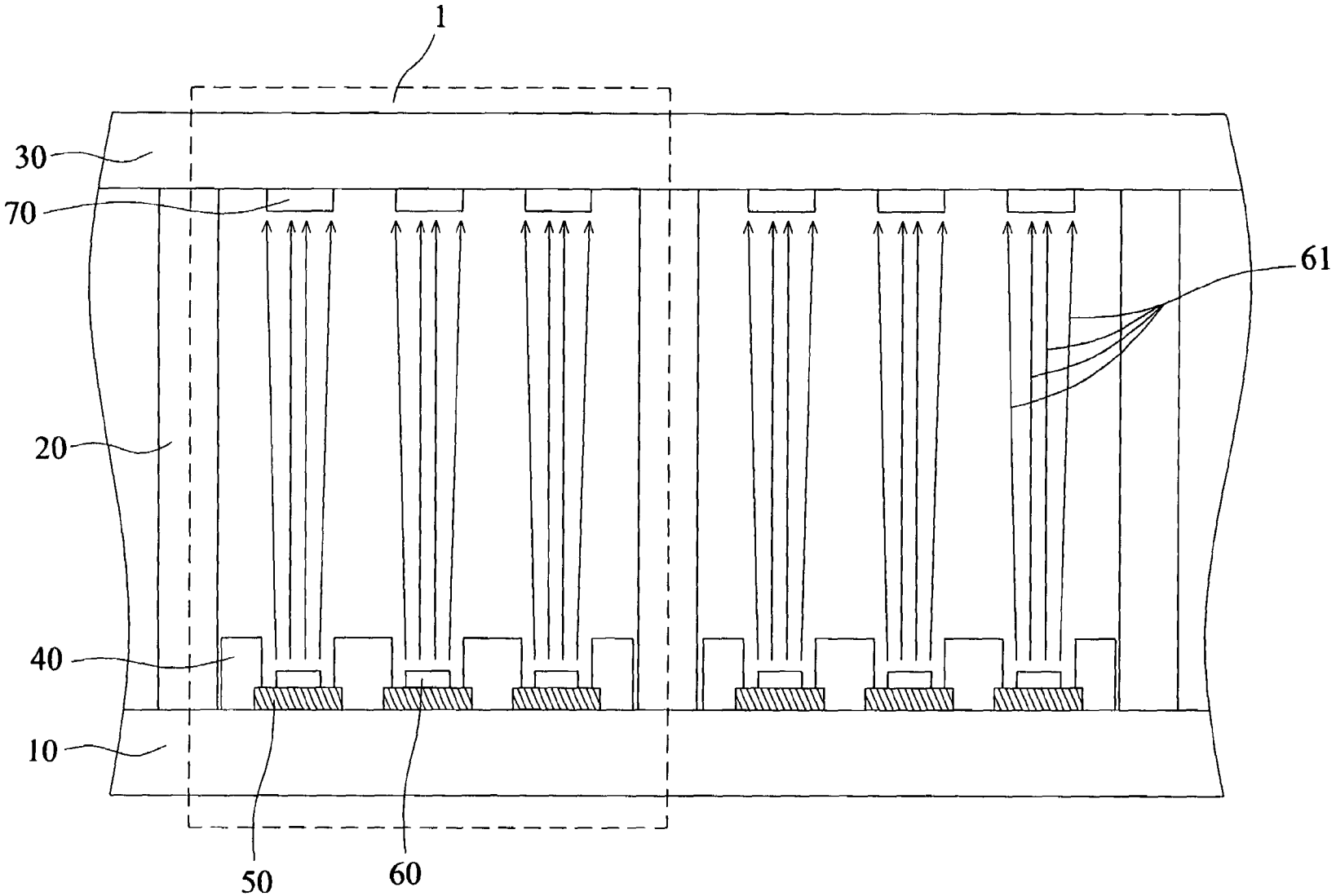
Fig. 1 (Prior Art)
FIG. 1 is a perspective diagram of a prior art field emission display unit.
Figure 2:
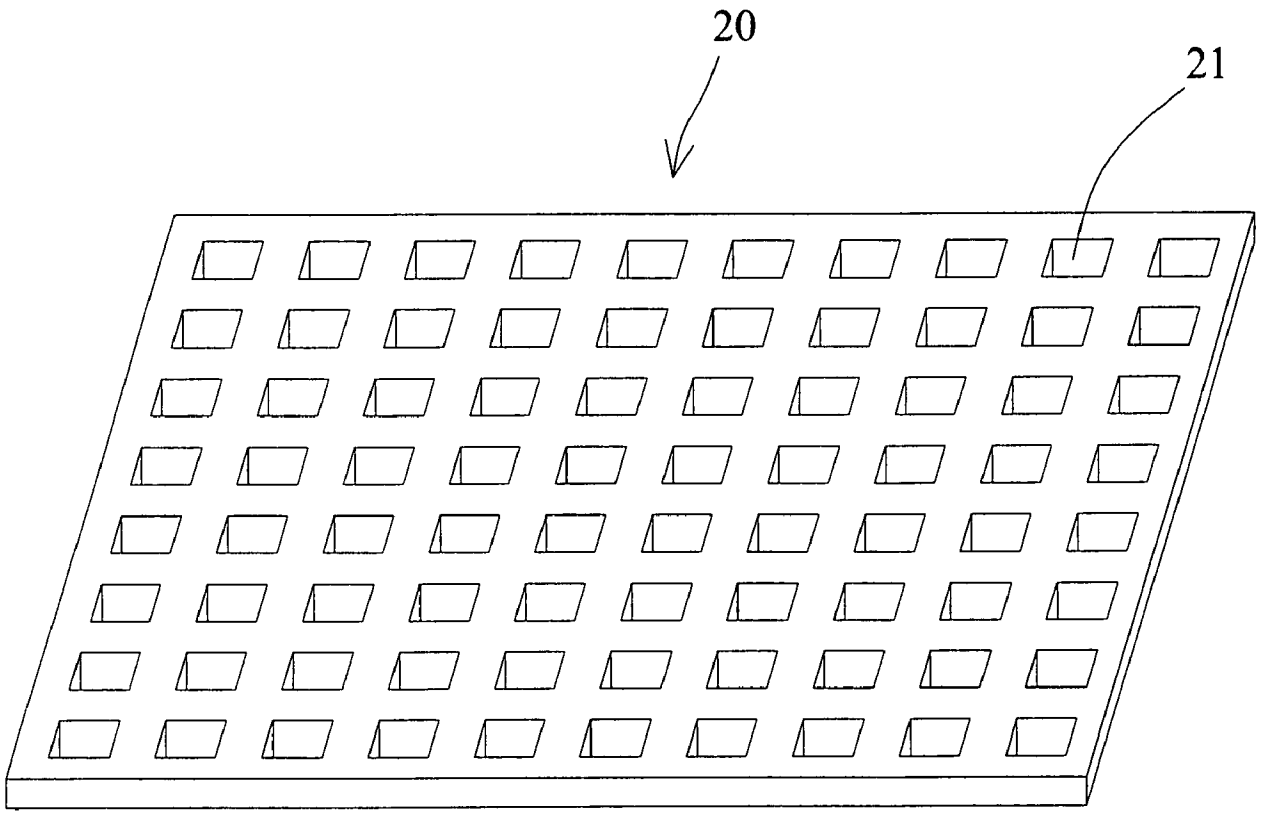
Fig. 2 (Prior Art)
FIG. 2 is a perspective diagram of a prior art supporting spacer structure.
Figure 3:
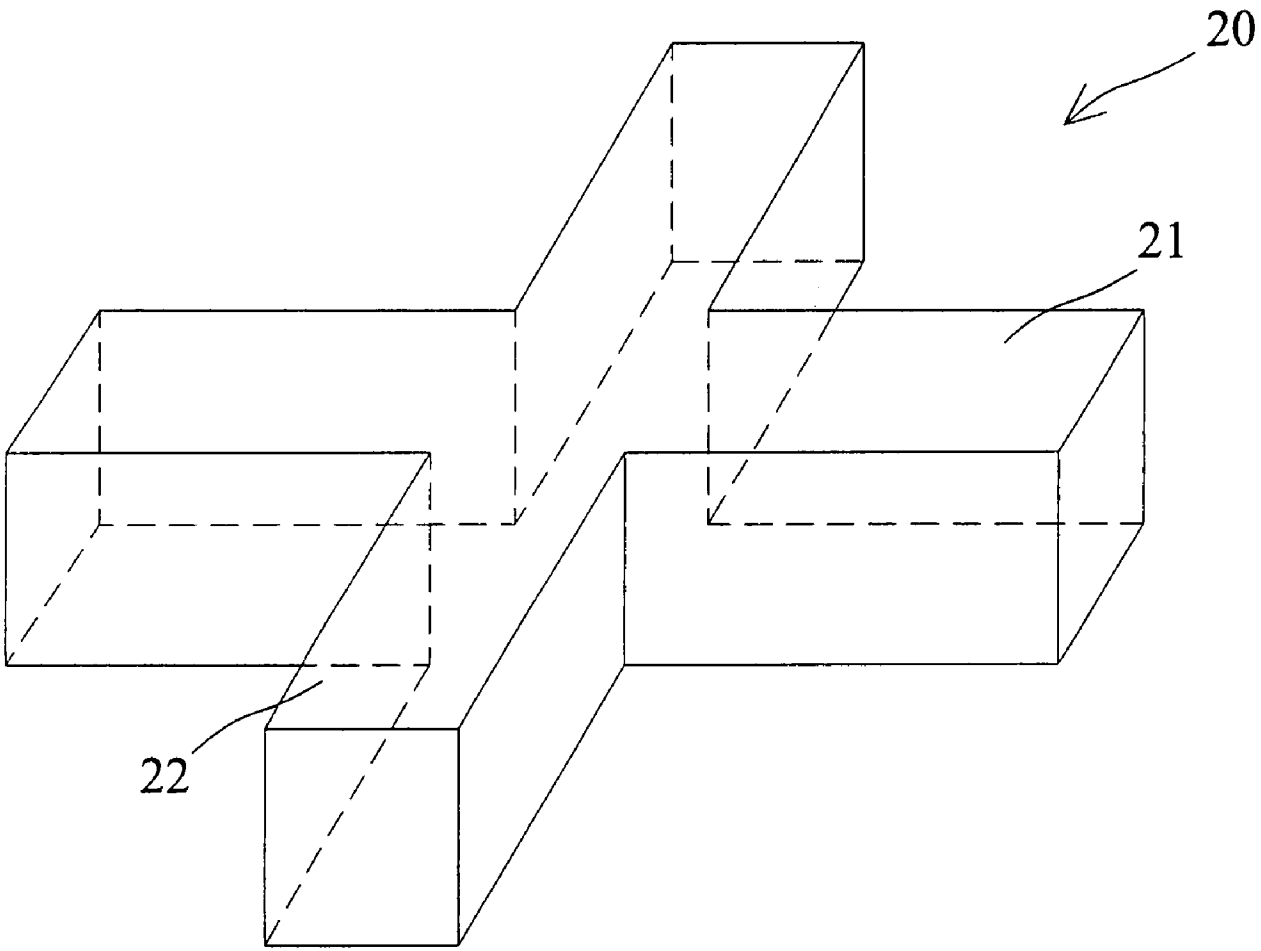
FIG. 3 is a perspective diagram of a supporting spacer structure according to an embodiment of the present invention.

Please refer to FIG. 3. FIG. 3 is a perspective diagram of a supporting spacer structure according to an embodiment of the present invention. As shown in FIG. 3, a supporting spacer 20 is cross-shaped. This supporting spacer 20 comprises a supporting unit 22 with a rectangle-shaped structure, and two clipping units 21 are extended from the middle place of the supporting unit 22. The height of the supporting spacer 20 is about 0.08~0.1 centimeters, the length of the two extended clipping units 21 is about 0.06~0.2 centimeters and the thickness is about 50~100 micrometers. Therefore, the preciseness is sufficient to achieve the requirement of high resolution for the field emission display, and the employed material is glass, ceramics or metal so that the hardness of the material is capable of satisfying the need for supporting the field emission display.

Figure 4:
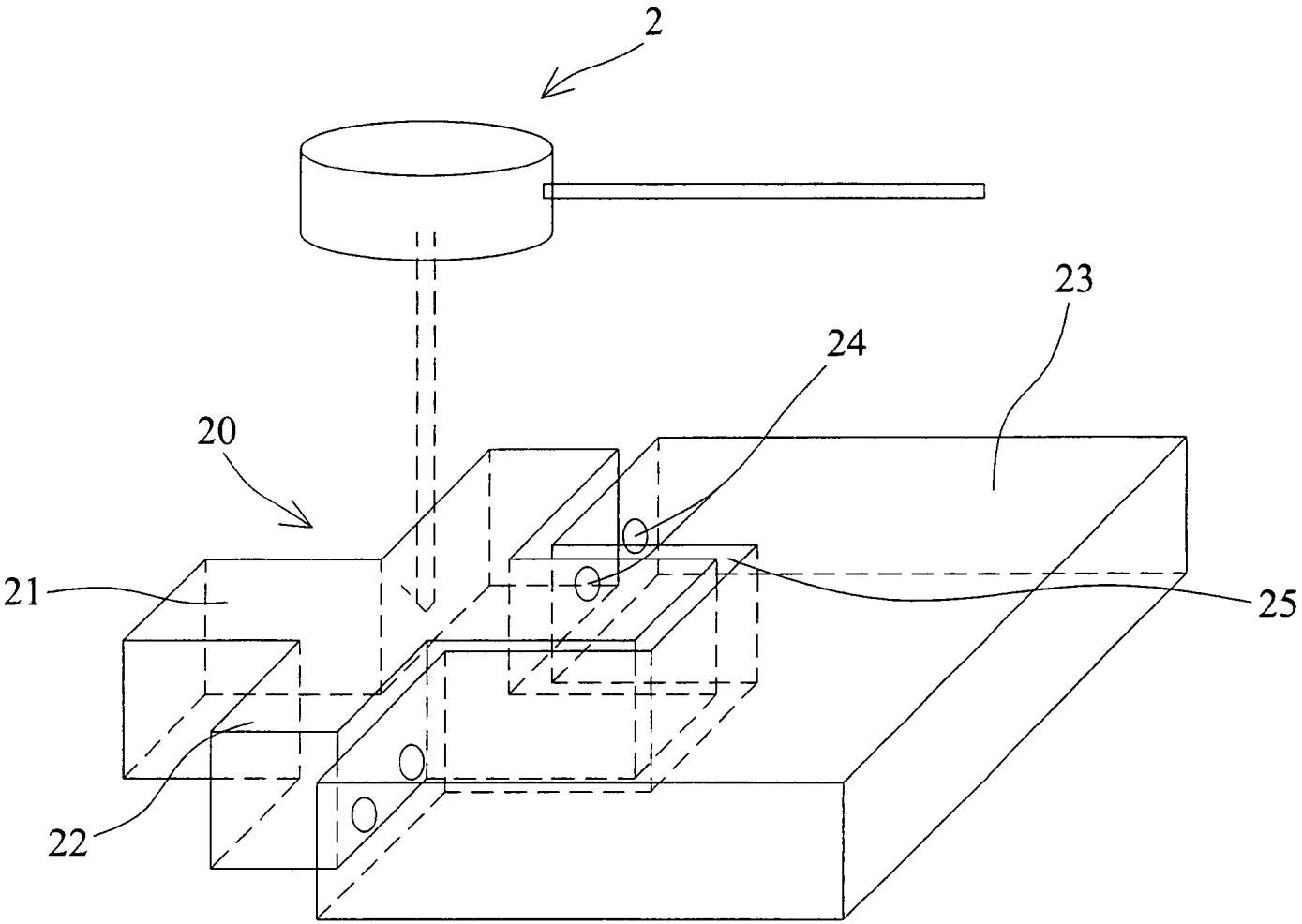
FIG. 4 is a perspective diagram of a mounting structure according to an embodiment of the present invention.

Please refer to FIG. 4. FIG. 4 is a perspective diagram of a mounting structure according to an embodiment of the present invention. A clipping arm 23 having a positioning slot 25 is used as a pre-aligner structure with a spacer, and therefore, when performing the operation of positioning the supporting spacer 20, one clipping unit 21 of the supporting spacer 20 is embedded into the positioning slot 25. Furthermore, the clipping arm 23 comprises a plurality of adsorption openings 24 which are installed on the same side surface of the positioning slot 25. Thus, when the operation of absorbing the supporting spacer 20 by using the clipping arm 23 is performed, the plurality of the adsorption openings 24 on the clipping arm 23 and on the same side surface of the positioning slot 25 will absorb the supporting spacer 20 and move it to the required position in each of the display units of the field emission display.

In addition, in the present invention, a CCD lens 2 composed of charge coupling elements is employed for real time monitoring when the clipping arm 23 is moving and positioning the supporting spacer 20. Therefore, the precise position-aligning can be achieved when the clipping arm 23 positioning the supporting spacer 20. Besides, a pre-position-aligning function can be obtained for making the operation more precise and efficient.

Figure 5:
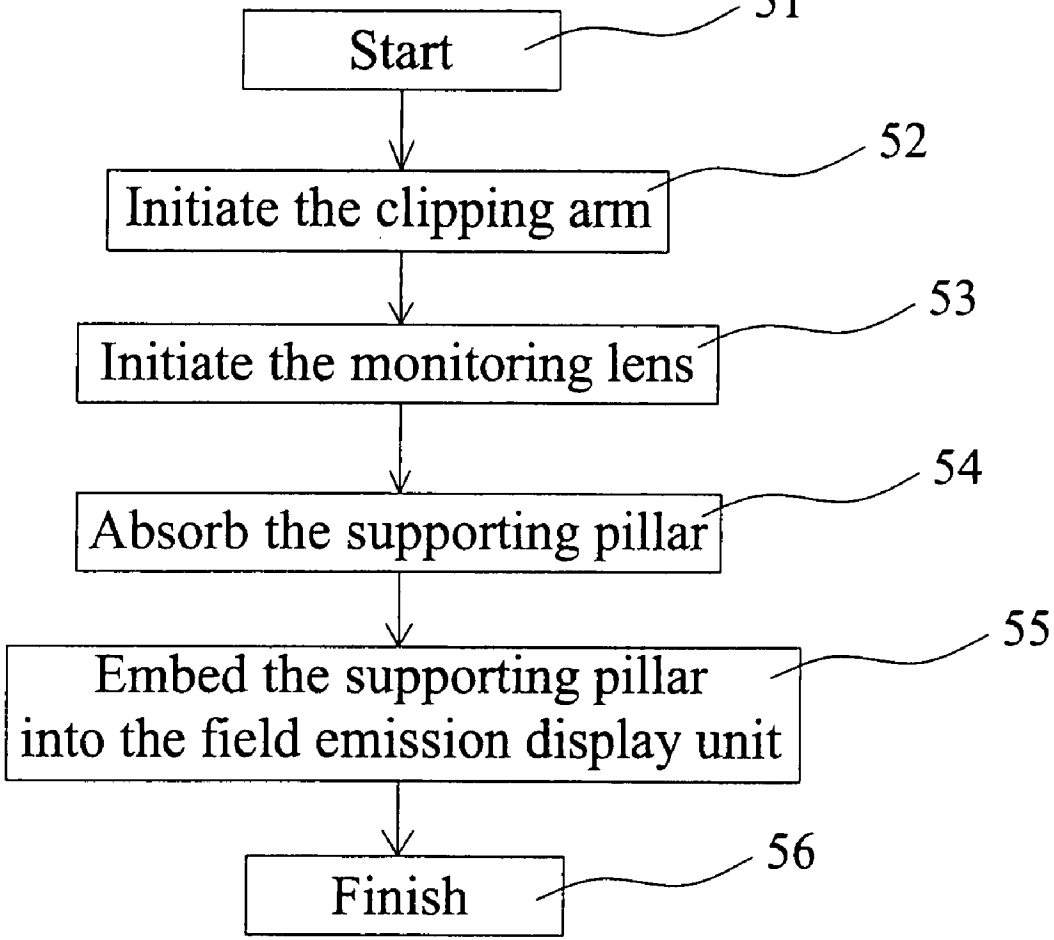
FIG. 5 is a flowchart of the steps operated in the embodiment of the present invention.

Please refer to FIG. 5. FIG. 5 is a flowchart of the steps operated in the embodiment of the present invention. When the clipping arm performs the operation of positioning the supporting spacer, after the starting (step 51), the clipping arm 52 will be initiated (step 52) and the vacuum process will be performed on the adsorption openings of the clipping arm, and the clipping arm will be moved. Then, in the step 53, the monitoring lens 53 is initiated for monitoring the process of positioning the supporting spacer by the clipping arm. When the clipping arm absorbs the supporting spacer 54 in the step 54, the supporting spacer is embedded into the positioning slot and the plurality of the adsorption openings on the same side surface will absorb the supporting spacer. Then, when the clipping arm moves the supporting spacer and puts it into each of the field emission display units 55 (step 55), the monitoring lens will monitor the entire process of precise positioning so as to accomplish the operation of positioning the supporting spacer (step 56). For the design of preliminary position-aligning slot, the clipping arm does not have to perform the position-aligning of the rotation angle during the operation of positioning.

The above is the description of the supporting spacer clipping structure for the field emission display according to the present invention. In the practical application, the inventive supporting spacer is a rectangle-shaped structure or a "+" structure where an extending arm is installed on the rectangle-shaped structure to be clipped by the clipping arm for positioning. In addition, because the clipping arm clips the supporting spacer by the plurality of absorption openings, and the absorption openings absorb the supporting spacer by vacuum-absorption. Therefore, compared with the prior art, the supporting spacer will not be damaged by the mechanical stress. Because one field emission display has many field emission display units, the monitoring lens of the invention further performs a process of pre-position-aligning so as to promote the efficiency of positioning supporting spacer, and the monitoring lens will monitor the entire process so as to make it efficient to position the supporting spacer in the required place.

Those skilled in the art will readily observe that numerous modifications and alterations of the device may be made while retaining the teachings of the invention. Accordingly, the above disclosure should be construed as limited only by the metes and bounds of the appended claims.

What is claimed is:

1. A supporting spacer mounting structure for a field emission display for supporting a field emission display unit by using a cross-shaped supporting spacer structure and the positioning of a clipping arm, the structure comprising:

a supporting spacer having a cross-shaped structure composed of a supporting unit and two clipping units; and a clipping arm used for absorbing the supporting spacer and positioning it into a field emission display unit;

wherein the positioning and supporting for supporting spacer of the field emission display are achieved by the two units.

2. The supporting spacer mounting structure for the field emission display of claim 1, wherein the field emission display is a display having a plurality of display units.

3. The supporting spacer mounting structure for the field emission display of claim 1, wherein the supporting spacer is made of glass, ceramics or metal.

4. The supporting spacer mounting structure for the field emission display of claim 1, wherein the supporting spacer has a structure of "+", or having at least one jointing seam.

5. The supporting spacer mounting structure for the field emission display of claim 1, wherein the clipping arm further comprises a positioning slot for positioning and position-aligning for a clipping unit of the supporting spacer, and the clipping arm does not has to perform the operation of position-aligning for the rotation angle.

6. The supporting spacer mounting structure for the field emission display of claim 1, wherein the clipping arm further comprises a plurality of adsorption openings, and the adsorption openings are installed on the same side of the positioning slot.

7. The supporting spacer mounting structure for the field emission display of claim 6, wherein the plurality of the adsorption opening installed on the clipping arm are used for vacuum-absorbing the side surfaces of the supporting units on the supporting spacer.

* * * * *